US005244147A

United States Patent [19]

Furukawa

[11] Patent Number: 5,244,147

[45] Date of Patent: Sep. 14, 1993

[54] FURNACE PRESSURE CONTROL METHOD

[75] Inventor: Masaaki Furukawa, Saitama, Japan

[73] Assignee: Ebara Corporation, Tokyo, Japan

[21] Appl. No.: 857,874

[22] Filed: Mar. 26, 1992

[51] Int. Cl.[5] ..... F23N 3/00

[52] U.S. Cl. ..... 236/15 C; 236/45; 110/163; 431/19; 431/20

[58] Field of Search ..... 236/15 C, 45; 126/307 A, 312; 437/19, 20; 110/123, 147, 162, 163

[56] References Cited

U.S. PATENT DOCUMENTS 4,402,303 9/1983 Koenneman ..... 236/15 C

FOREIGN PATENT DOCUMENTS 61-49929 3/1986 Japan .
443544 2/1968 Switzerland .
2025592 1/1980 United Kingdom ..... 236/15 C
2190515 11/1987 United Kingdom .

OTHER PUBLICATIONS

Patent Abstracts of Japan, vol. 10, No. 211 (M-501) Jul. 24, 1986.
Patent Abstracts of Japan, vol. 10, No. 100 (M-470) Apr. 16, 1986.
Patent Abstracts of Japan, vol. 13, No. 380 (M-863) Aug. 23, 1989.
"Guide Manual of Refuge Disposal Equipment Constructions", Aug. 25, 1987, p. 342.
"Environmental Equipment", 1986, pp. 63-64.

*Primary Examiner*—Harry B. Tanner
*Attorney, Agent, or Firm*—Wenderoth, Lind & Ponack

[57] ABSTRACT

A method of controlling the pressure in an incinerator for incinerating municipal refuse, industrial waste, etc. Exhaust gas from an incinerator typically passes through an exhaust gas cooler and an exhaust gas treating device and then discharged into the atmosphere by the action of an induced draft fan. In a method of controlling the pressure in such an incinerator for incinerating municipal refuse, industrial waste, etc. gas, e.g., part of the flow of exhaust gas induced by the induced draft fan or air taken in from the atmosphere, is added to a gas flow path upstream of the inlet of the induced draft fan through an addition gas line provided with an addition gas control damper. The addition gas control damper is controlled on the basis of an output from a furnace pressure controller such that when the furnace pressure is relatively high, the flow rate of the addition gas is reduced, whereas, when the furnace pressure is relatively low, the flow rate of the addition gas is increased.

8 Claims, 8 Drawing Sheets

FURNACE PRESSURE CONTROL METHOD

BACKGROUND OF THE INVENTION

The present invention relates to a method of controlling the pressure in an incinerator for incinerating municipal refuse, industrial waste, etc. by controlling the flow rate of exhaust gas.

In an incinerator for municipal refuse or the like, the pressure in the furnace must be constantly kept at a predetermined negative pressure from the viewpoint of safety. If the negative pressure is excessively high, the amount of leakage air at the furnace, an exhaust gas cooler, a gas treating device, an exhaust gas duct, etc. is high, whereby the amount of exhaust gas is high resulting in a large amount of electric power being consumed by an induced draft fan. Accordingly, it is necessary to regulate the pressure in the furnace to an appropriate negative pressure.

In general, the control of the pressure in an incinerator has heretofore been effected by using a simple control system such as that shown in FIG. 2, in which reference numeral 1 denotes an incinerator, 2 a gas cooler, 3 a gas treating device, 4 a remote-control exhaust gas damper for controlling the flow rate of exhaust gas, 5 an induced draft fan for suction of exhaust gas, and 6 a stack. The incinerator 1 is fed with fuel 7 and combustion air 8. Reference numeral 13 denotes leakage. The pressure in the incinerator 1 that is detected by a detecting element 9 is transmitted by a pressure transmitter 10 to a controller 12 including a PID controller 11, where it is compared with a furnace pressure set value to obtain a manipulated variable signal, and the remote-control exhaust gas damper 4, serving as a final control element, is controlled on the basis of the manipulated variable signal to thereby control the flow rate of exhaust gas.

Such a conventional control system is satisfactory for practical use in general combustion furnaces but not for incinerators designed for municipal refuse, which refuse varies greatly in both quality and quantity, because such incinerators have drastic, oscillatory and irregular variations in the furnace pressure in comparison with relatively stable furnaces such as heavy oil incinerators. Accordingly, it is difficult for a simple control system such as that described above to effect a stable control of the pressure in the incinerators for municipal refuse.

There is a prior art control system designed to cope with this problem, e.g., the one disclosed in Japanese Patent Public Disclosure (KOKAI) No. 61-49929 (1986) entitled "Furnace Pressure Control System", filed by the present applicant. FIG. 3 shows the arrangement of this furnace pressure control system. Referring to the figure, a controller 12 includes a first-order lag filter 15, a subtracter 16, a non-linear operator 17, a differentiator 18, a non-linear operator 19 and an adder 20. The differentiator 18 and the non-linear operator 19 constitute in combination a differential output circuit 21.

In the furnace pressure control system having the above-described arrangement, when the differential output circuit 21 is not employed, the pressure in the incinerator 1 is transmitted as an output $PV_0$ to the first-order lag filter 15 by the pressure transmitter 10. The filter 15 filters out ripples to produce an output $PV_1$. The subtracter 16 obtains a difference between the output $PV_1$ and a set value SV in the PID controller 11 and delivers an output $PV_2$, which is input to the non-linear operator 17. The operator 17 delivers an output $PV_3$ with a gain selected in accordance with conditions, that is, whether $SV<PV_1$ or $SV>PV_1$.

More specifically, the gain that is selected when $SV<PV_1$ is larger than that when $SV>PV_1$.

The output $PV_3$ is subjected to a PID operation in the PID controller 11 to deliver an output $MV_1$, which is input to the adder 20 to deliver an output $MV_0$. In this case, there is no input to be added to $MV_1$. Hence, $MV_0=MV_1$. With the output $MV_0$, the remote-control exhaust gas damper 4 is controlled. However, since the gain is changed as described above, the value of the output $MV_0$ is larger when $SV<PV_1$ than in when $SV>PV_1$. Accordingly, the operating speed of the remote-control exhaust gas damper 4, which is a final control element, is higher when $SV<PV_1$ than when $SV>PV_1$, thereby promptly suppressing the rise in the furnace pressure, and thus preventing it from becoming positive.

When the differential output circuit 21 is employed in the furnace pressure control system shown in FIG. 3, the non-linear operator 17 may not necessarily need to change the gain on the basis of the comparison between SV and $PV_1$. The output $PV_0$ is differentiated in the differentiator 18 to deliver an output $y_1$, which is input to the non-linear operator 19. The operator 19 delivers an output $y_2$ only when the differential value is positive. The output $y_2$ is added to the output $MV_1$ delivered from the PID controller 11 as a fundamental manipulated variable in the adder 20 to generate a corrected manipulated variable signal $MV_0$, which is used to control the remote-control exhaust gas damper 4 serving as a final control element. An upward tendency of the furnace pressure is judged by the fact that the differential value is positive, and in such a case a larger manipulated variable is given to the final control element to increase the operating speed of the exhaust gas damper 4, thereby promptly suppressing the rise in the furnace pressure, and thus preventing it from becoming positive.

Recently, exhaust gas treatment has been improved. That is, it has heretofore been common practice to employ an electrostatic precipitator for exhaust gas treatment, whereas it has recently become common practice to employ a bag filter or wet-type treatment or to pass exhaust gas through a chemical-packed bed. Thus, the pressure loss is high in the recent treatment of exhaust gas. When the exhaust gas treatment is accompanied by a large pressure loss, it is likely with the method disclosed in Japanese Patent Public Disclosure (KOKAI) NO. 61-49929 (1986) that the induced draft fan 5 will transiently have a deficient capacity due to the delay in operation of the remote-control exhaust gas damper 4, resulting in an abnormally positive furnace pressure. If the furnace pressure becomes positive, the combustion gas leaks out of the system, which is unfavorable for the working environment.

SUMMARY OF THE INVENTION

In view of the above-described circumstances, it is an object of the present invention to provide a furnace pressure control method which is capable of promptly following up a change in the flow rate of exhaust gas to stabilize the furnace pressure.

To attain the above-described object, the present invention provides a method of controlling the pressure in an incinerator for incinerating municipal refuse, industrial waste, etc., by controlling the flow rate of a gas which is added to a gas flow upstream of the inlet of a induced draft fan, comprising: passing exhaust gas from the incinerator through an exhaust gas cooler, an exhaust gas treating device and a remote-control exhaust gas and damper then discharging it into the atmosphere by the action of an induced draft fan; feeding either part of the flow of exhaust gas induced by the induced draft fan or air taken in from the atmosphere to the inlet of the remote-control exhaust gas damper or the inlet of the exhaust gas treating device or the inlet of the exhaust gas cooler or the inside of the incinerator through an addition gas line provided with an addition gas control damper; and controlling the addition gas control damper on the basis of an output from a furnace pressure controller such that when the furnace pressure is relatively high, the flow rate of the addition gas is reduced, whereas, when the furnace pressure is relatively low, the flow rate of the addition gas is increased.

According to the present invention, the gain that is used when the furnace pressure is on the plus side of a set value for the furnace pressure controller is larger than the gain that is used when the furnace pressure is on the minus side of the set value so that when the furnace pressure is on the plus side, the addition gas control damper is operated at a relatively high speed.

In addition, the addition control damper is operated even more rapidly when a sudden change of the furnace pressure toward the plus side of the set value is detected.

In addition, the present invention is characterized by combining the control operation in which the gain is changed according to whether the furnace pressure is on the plus or minus side of the set value for the furnace pressure controller and the control operation in which the addition gas control damper is operated even more rapidly when a sudden change of the furnace pressure toward the plus side of the set value is detected.

By virtue of the above-described method, the addition gas control damper that is installed in the addition gas line is used as a final control element for the furnace pressure control, and the addition gas control damper is opened and closed so as to compensate for a change in the flow rate of combustion gas through the addition gas line. Therefore, the induced draft fan is allowed to operate with its maximum capacity at all times. Accordingly, when the flow rate of exhaust gas increases rapidly (i.e., when the furnace pressure rises), the addition gas control damper is closed, so that the exhaust gas is aspirated by the induced draft fan operating at maximum capacity thus enabling the furnace pressure to be stabilized promptly.

In addition, the gain that is used when the furnace pressure is on the plus side of the set value for the furnace pressure controller is relatively large so that when the furnace pressure is on the plus side of the set value, the addition gas control damper is operated at a relatively high speed, thereby promptly suppressing the rise in furnace pressure.

When a sudden change in the furnace pressure toward the plus side of the set value of the furnace pressure controller is detected, the addition gas control damper is operated even more rapidly, thereby promptly suppressing the rise in the furnace pressure.

By virtue of the fact that the output of said furnace pressure controller that controls said addition gas control damper is the sum of an output of a PID controller characterized by a fundamental manipulated variable and a signal which is inversely proportional to the change of the furnace pressure, the fluctuation of the furnace pressure is reduced speedily and a stability thereof is recovered quickly.

Since the addition gas control damper is fully closed when the furnace pressure is higher than a first set pressure and the damper is fully opened when the furnace pressure is lower than a second set pressure, the stability of the furnace pressure is speedily recovered and further, the exhaust gas is prevented from being released into the atmosphere without being treated by being returned through the addition gas line.

BRIEF DESCRIPTION OF THE DRAWINGS

The above and other objects, features and advantages of the present invention will become more apparent from the following description of the preferred embodiments thereof, taken in conjunction with the accompanying drawings, in which like reference numerals denote like elements, and of which.

DETAILED DESCRIPTION OF THE PREFERRED EMBODIMENTS

Embodiments of the present invention will be described below with reference to the accompanying drawings. It should be noted that the present invention is not necessarily limited to these embodiments.

Figure 1:
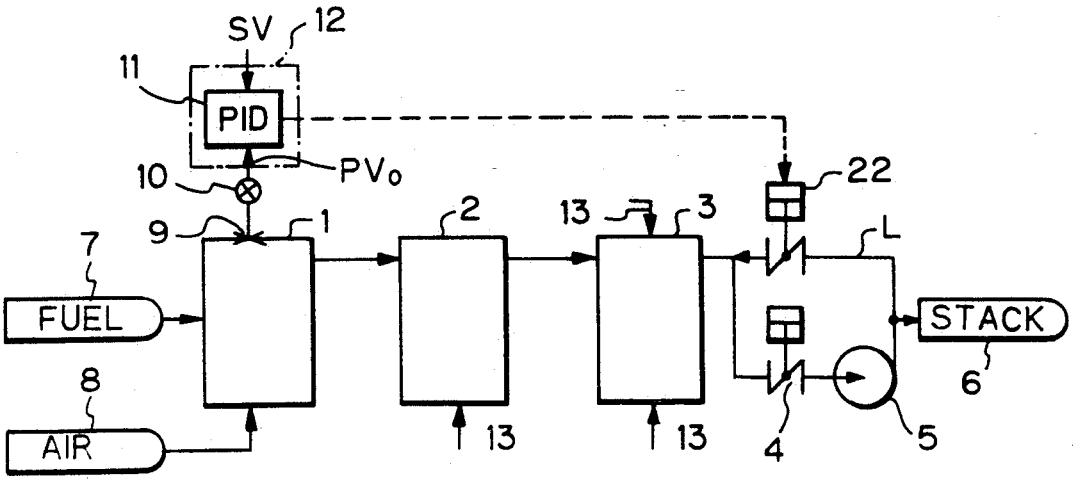
FIG. 1 is a schematic diagram of a furnace pressure control system which may be employed to carry out the furnace pressure control method of the present invention.

FIG. 1 shows a furnace pressure control system which may be employed to carry out the furnace pressure control method of the present invention. In the figure, the same reference numerals as those in FIGS. 2 and 3 denote the same or equivalent portions or elements (the same is the case with other drawings).

As shown in FIG. 1, the furnace pressure control system is provided with an addition gas line L for feeding back part of the flow of exhaust gas induced by the action of an induced draft fan 5 to the inlet of a remote-control exhaust gas damper 4. The addition gas line L is provided with an addition gas control damper 22.

In the furnace pressure control system having the above-described arrangement, the pressure $PV_o$ in the incinerator 1 is detected by a detecting element 9 and then transmitted to a controller 12 by a pressure transmitter 10. In the controller 12, the detected pressure $PV_o$ is compared with a set value SV in a PID controller 11 and is subjected to a PID operation to control the addition gas control damper 22 installed in the addition gas line L, thereby stabilizing the pressure in the incinerator 1.

The remote-control exhaust gas damper 4 is a manual damper which is fully closed when the induced draft fan 5 is started. When the induced draft fan 5 is in operation, the damper 4 is opened to a predetermined degree (substantially fully open). In this arrangement, the maximum capacity of the induced draft fan 5 is defined by the upper limit of the addition gas control damper 22.

Figure 2:
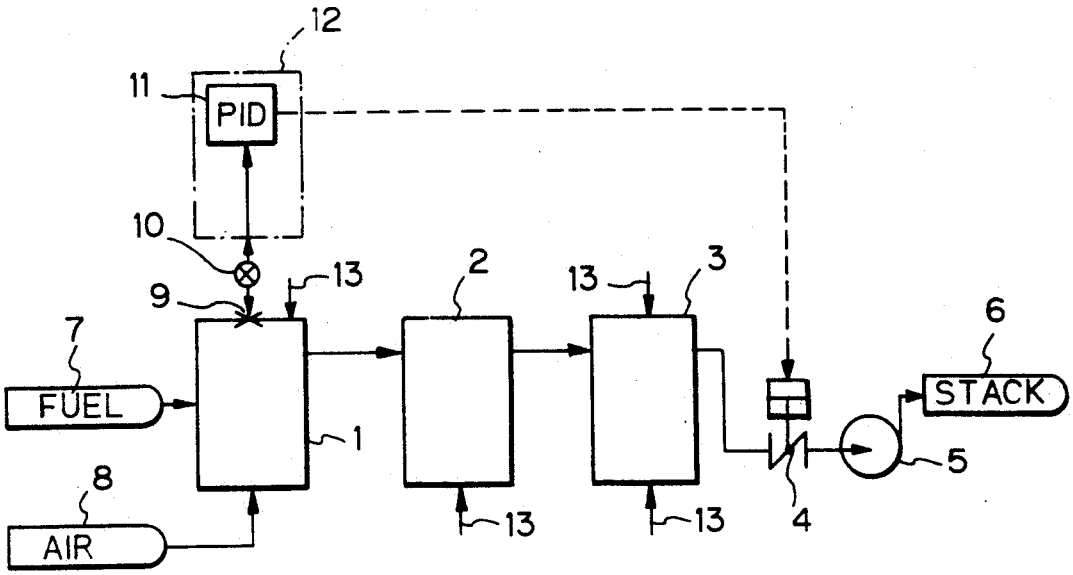
FIGS. 2 and 3 are schematic diagrams of respective conventional furnace pressure control systems.
Figure 3:
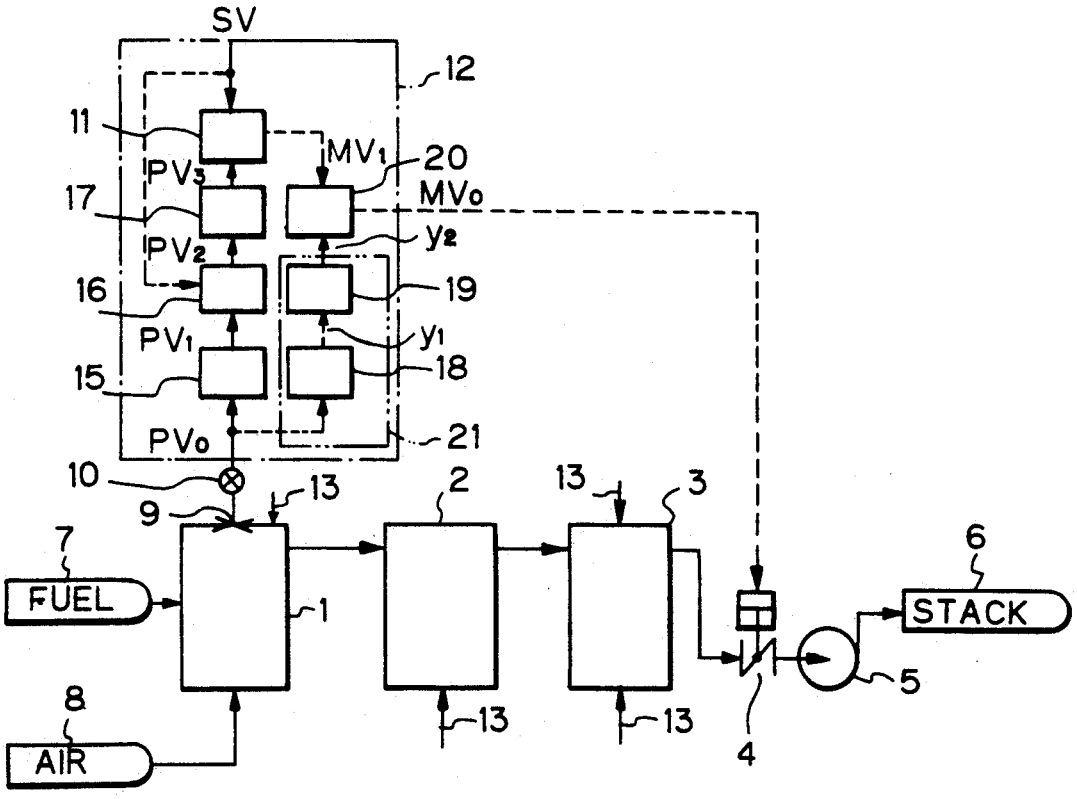

Since municipal refuse or the like cast into the incinerator 1 varies in both quality and quantity, the flow rate of combustion gas generated therefrom also varies. As a result, the furnace pressure also varies. Hitherto, the remote-control exhaust gas damper 4 has been controlled as a final control element to stabilize the furnace pressure, as shown in FIGS. 2 and 3. Therefore, the operating point of the induced draft fan 5 has heretofore been set at a level where it operates with a reduced capacity. In this embodiment, the addition gas control damper 22 that is installed in the addition gas line L is used as a final control element, and the addition gas control damper 22 is opened and closed so as to compensate for a change in the flow rate of combustion gas through the addition gas line L. Therefore, the induced draft fan 5 is allowed to operate with its maximum capacity. Accordingly, when the flow rate of exhaust gas increases rapidly (i.e., when the furnace pressure rises), the addition gas control damper 22 is closed, so that the exhaust gas is sectioned under the maximum capacity of the induced draft fan 5, thus enabling the furnace pressure to be stabilized promptly.

Figure 4:
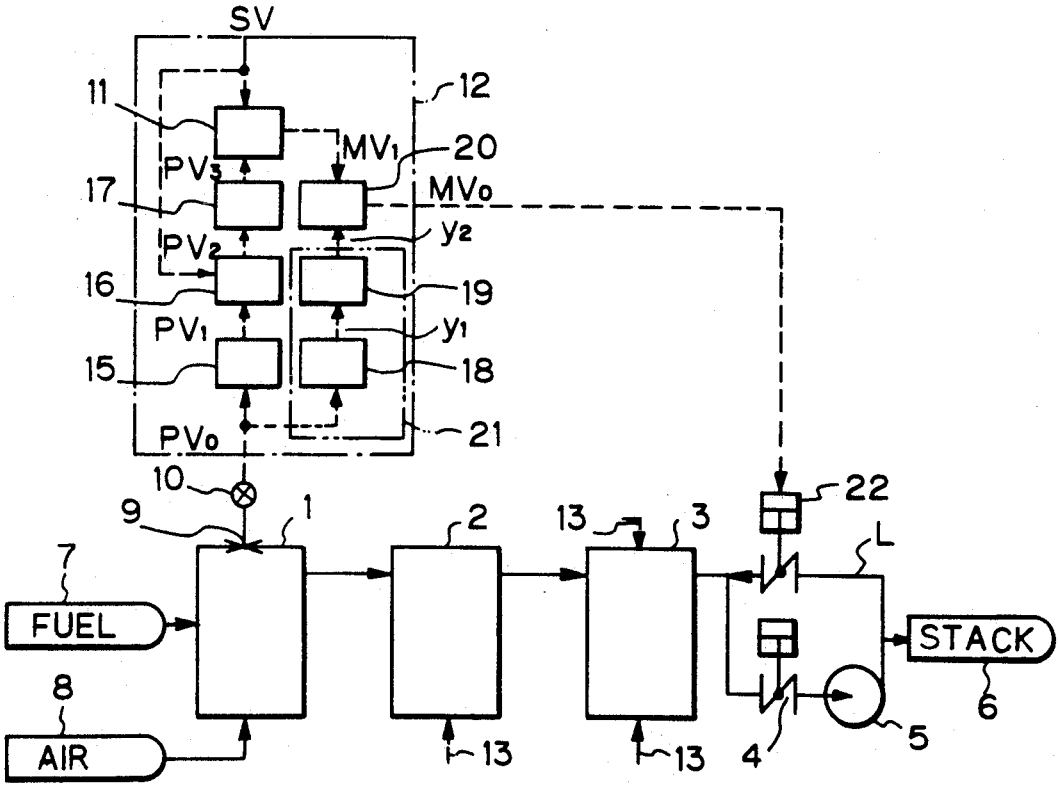
FIGS. 4, 5, 6, 7, 8, 9, 10 and 11 are schematic diagrams of other furnace pressure control systems, respectively, which may be employed to carry out the furnace pressure control method of the present invention.

FIG. 4 shows another furnace pressure control system which may be employed to carry out the furnace pressure control method of the present invention. This furnace pressure control system employs a controller 12 having the same arrangement as that of the controller 12 shown in FIG. 3 and controls the addition gas control damper 22 provided in the addition gas line L on the basis of the output of the controller 12.

In the furnace pressure control system shown in FIG. 4, when the differential output circuit 21 is not employed, the pressure in the incinerator 1 is transmitted as an output $PV_0$ to the first-order lag filter 15 by the pressure transmitter 10. The filter 15 filters out ripples to provide an output $PV_1$. The subtracter 16 obtains a difference between the output $PV_1$ and a set value SV in the PID controller 11 and delivers an output $PV_2$, which is input to the non-linear operator 17. The operator 17 delivers an output $PV_3$ with a gain selected in accordance with conditions, that is, whether $SV<PV_1$ or $SV>PV_1$.

More specifically, the gain that is selected when $SV<PV_1$ is larger than that when $SV>PV_1$.

The output $PV_3$ is subjected a PID operation in the PID controller 11 to deliver an output $MV_1$, which is input to the adder 20 to deliver an output $MV_0$. In this case, there is no input to be added to $MV_1$. Hence, $MV_0=MV_1$. With the output $MV_0$, the addition gas control damper 22 installed in the addition gas line L is controlled. However, since the gain is changed as described above, the value of the output $MV_0$ is larger when $SV<SV_1$ than when $SV>PV_1$. Accordingly, the speed at which the addition gas control damper 22, which is a final control element, is closed is higher when $SV<PV_1$ than when $SV>PV_1$, thereby increasing the flow rate of exhaust gas released in the atmosphere through the stack 6, and thus making it possible to promptly suppress the rise in the furnace pressure and prevent it from becoming positive.

When the differential output circuit 21 is employed, the non-linear operator 17 may not necessarily need to change the gain on the basis of the size comparison between SV and $PV_1$. The output $PV_0$ is differentiated in the differentiator 18 to deliver an output $y_1$, which is input to the non-linear operator 19. The operator 19 delivers an output $y_2$ only when the differential value is positive. The output $y_2$ is added to the output $MV_1$ delivered from the PID controller 11 as a fundamental manipulated variable in the adder 20 to generate a corrected manipulated variable signal $MV_0$, which is used to control element. An upward tendency of the furnace pressure is judged by the fact that the differential value is positive, and in such a case a larger manipulated variable is used to control the addition gas control damper 22 as a final control element to increase the closing operation speed of the addition gas control damper 22, thereby promptly suppressing the rise in the furnace pressure, and thus preventing it from becoming positive.

Figure 5:
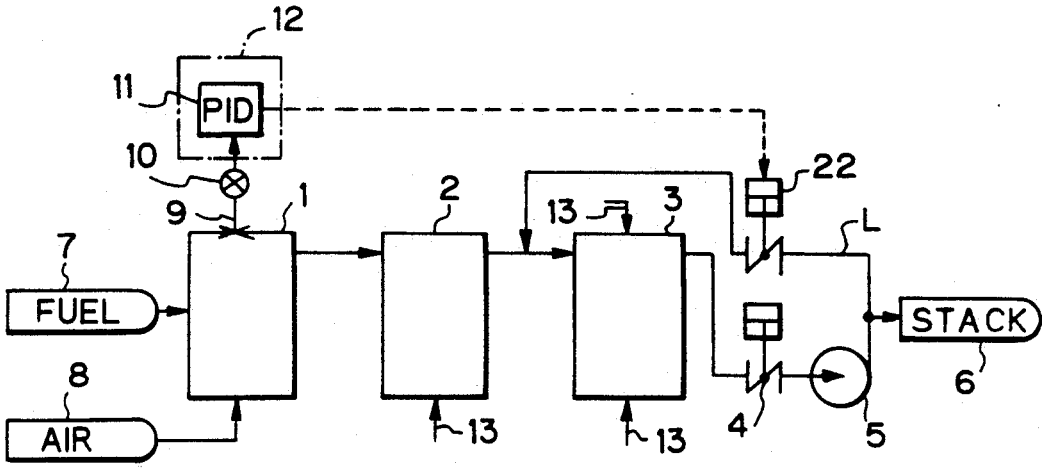
Figure 6:
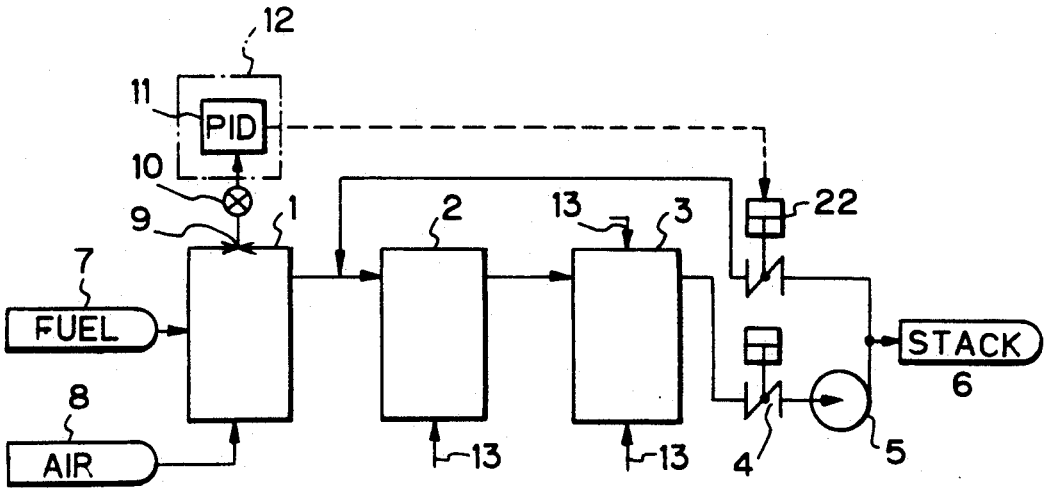
Figure 7:
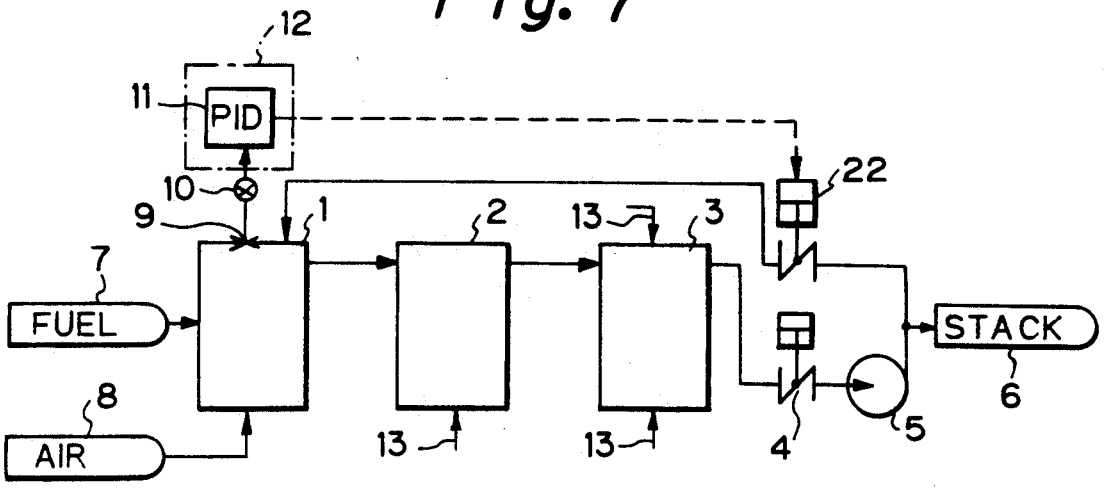

In the furnace pressure control systems shown in FIGS. 1 and 4 it should be noted that the adding end of the addition gas line L is not limited to being connected to the inlet of the remote-control exhaust gas damper 4. The adding end of the addition gas line L may be connected to the inlet of the gas treating device 3 as shown in FIG. 5, or to the inlet of the gas cooler 2 as shown in FIG. 6, or to the inside of the incinerator 1 as shown in FIG. 7.

FIGS. 8, 9, 10 and 11 show other furnace pressure control systems, respectively, which may be employed to carry out the furnace pressure control method of the present invention.

Figure 8:
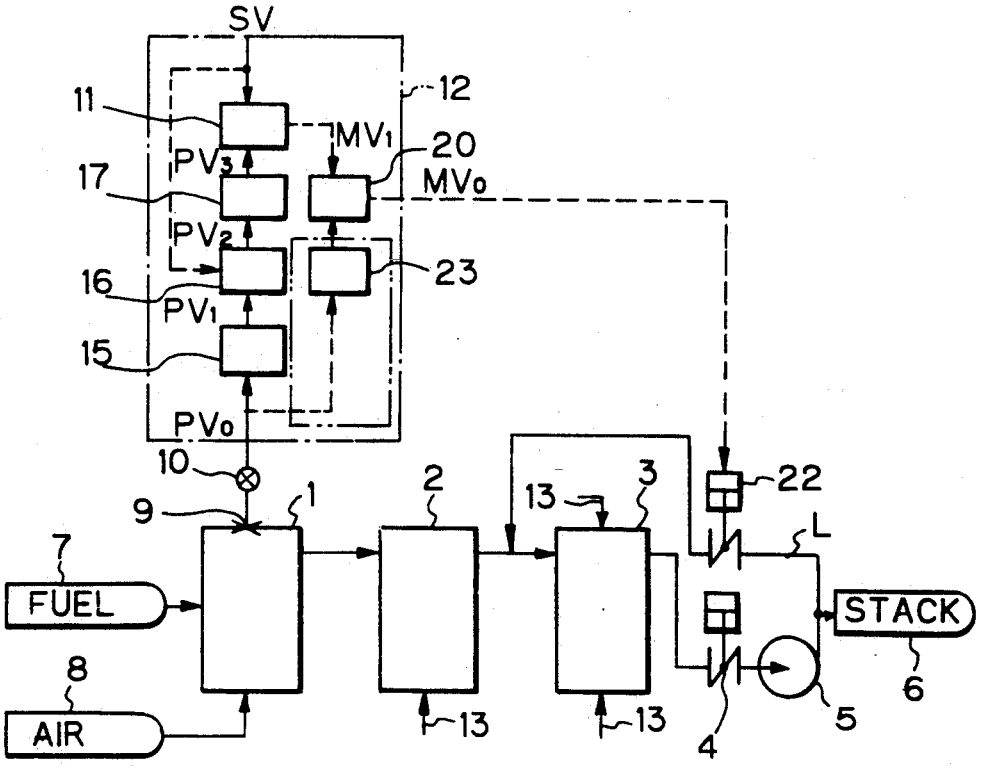
Figure 12:
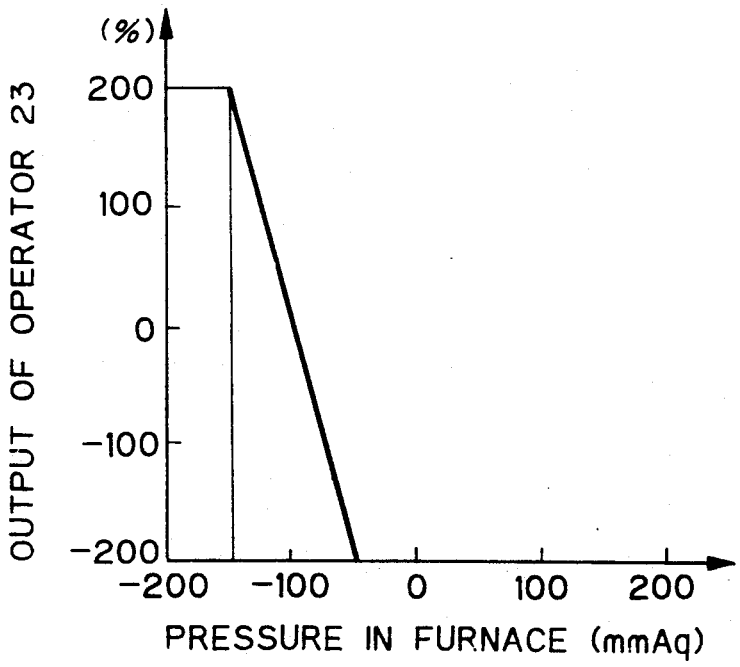
FIGS. 12, 13 and 14 are graphs respectively showing the output of an inversely proportional operator employed in the system shown in FIG. 8.

The control system of FIG. 8 has an arrangement in which the differential output circuit 21 in the furnace pressure control system shown in FIG. 4 is replaced with a non-linear operator 23 and the addition gas line L is connected to the inlet of the gas treating device 3. The output of the non-linear operator 23 is inversely proportional to the change in the furnace pressure, as shown in FIG. 12, and is added to the output $MV_1$ (in %) from the PID controller 11. In the example shown in FIG. 12, when the furnace pressure is −50 mmAq or higher, the output of the non-linear operator 23 is always 200%, so that the addition gas control damper 22 will be fully closed and no exhaust gas is released through the addition gas line L. When the furnace pressure is −150 mmAq or lower, the output of the non-linear operator 23 is a high constant value, so that the addition gas control damper 22 is fully opened. Thus, the lower the furnace pressure, the higher the flow rate of exhaust gas returned to the upstream side of the exhaust gas that is duct 4.

Figure 9:
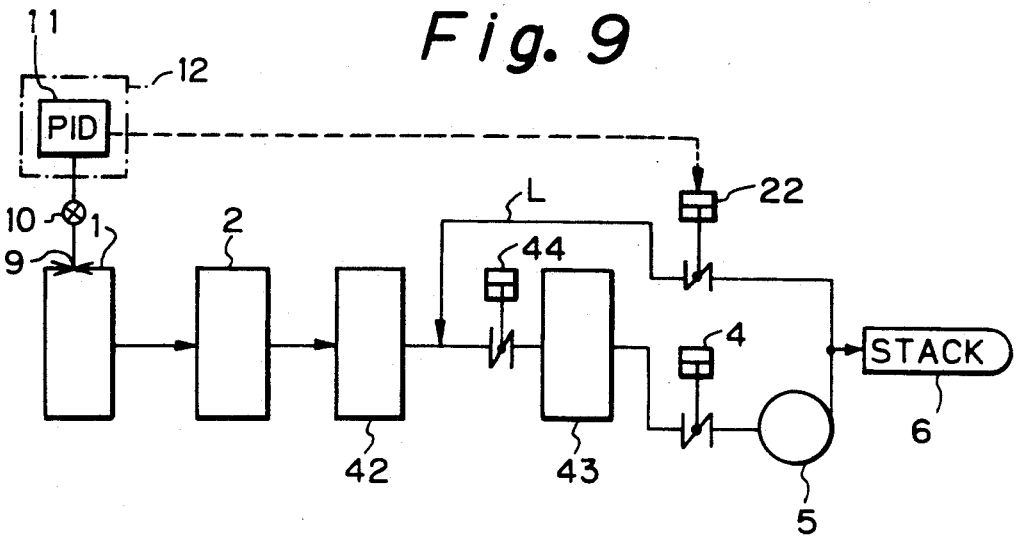

In the furnace pressure control system shown in FIG. 9, the exhaust gas treating device comprises an electrostatic precipitator 42 and a wet-type gas treating machine 43, and a protective damper 44 is disposed at the inlet of the wet-type gas treating machine 43. Part of the flow of exhaust gas induced by the induced draft fan 5 passes through the addition gas control damper 22 and the addition gas line L to flow back to the gas flow path between the electrostatic precipitator 42 and the protective damper 44.

In the furnace pressure control system shown in FIG. 9, the protective damper 44 is closed when needed to prevent the wet-type gas treating machine 43 from being damaged by heat. When the protective damper 44 is closed, the operation of the furnace is stopped and the addition gas control damper 22 is opened, so that exhaust gas discharged from the electrostatic precipitator 42 is led to the stack 6 through the addition gas line L and the addition gas control damper 22.

Figure 10:
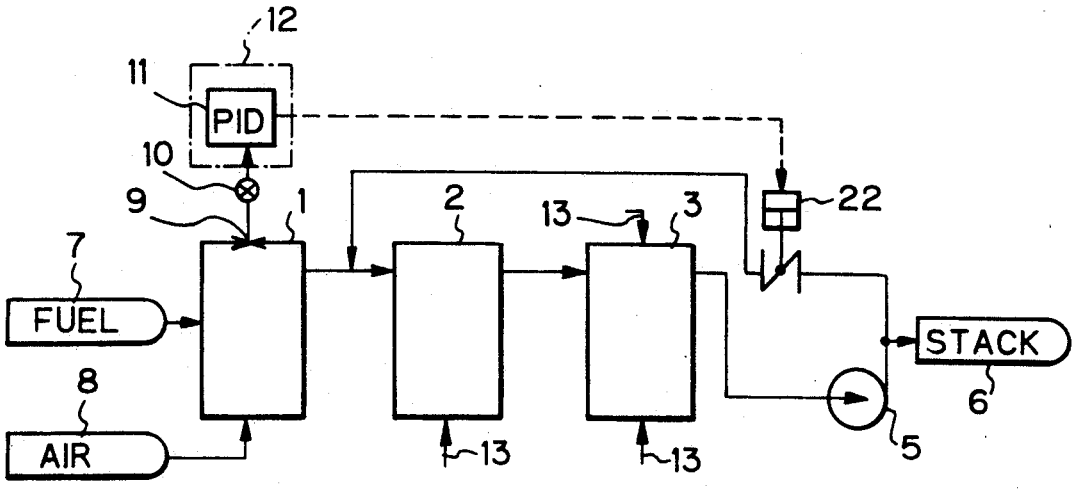

The furnace pressure control system shown in FIG. 10 has an arrangement in which the remote-control exhaust gas damper 4 and the induced draft fan 5 in the system shown in FIG. 6 are replaced with an inverter-driven induced draft fan 51. With this arrangement, the flow loss of exhaust gas is smaller than in the case where the damper 4 is provided, so that the exhaust gas can be induced to flow even more rapidly when the furnace pressure rises.

Figure 11:
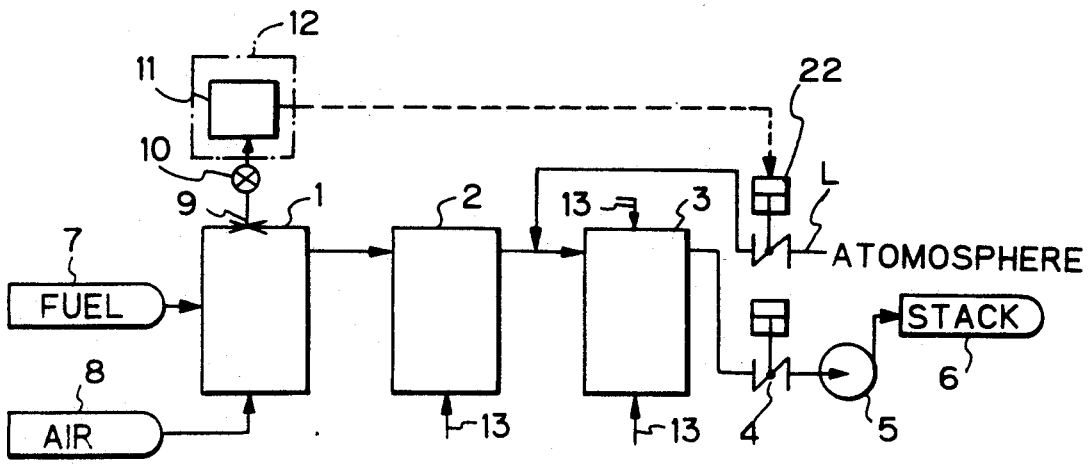

The furnace pressure control system shown in FIG. 11 has the same arrangement as that of the furnace pressure control system shown in FIG. 5 except that in the system shown in FIG. 11 the addition gas control damper 22 communicates with the atmosphere through a line L, whereas in the system shown in FIG. 5 the discharge port of the induced draft fan 5 and the addition gas control damper 22 communicate with each other. In the furnace pressure control system shown in FIG. 11, when the furnace pressure is relatively low, the air is supplied to the gas flow path between the gas cooler 2 and the gas control damper 22.

FIG. 12 shows a first type of output characteristic of the non-linear operator 23 used in the controller shown in FIG. 8. When the furnace pressure is not lower than −50 mmAq, the output is always −200% which causes the additional gas control damper 22 to be fully closed because the output of the adder can thus not be higher than −100%. When the furnace pressure is not higher than −150 mmAq, the output is a high constant value which causes the additional gas control damper 22 to be fully opened.

Figure 13:
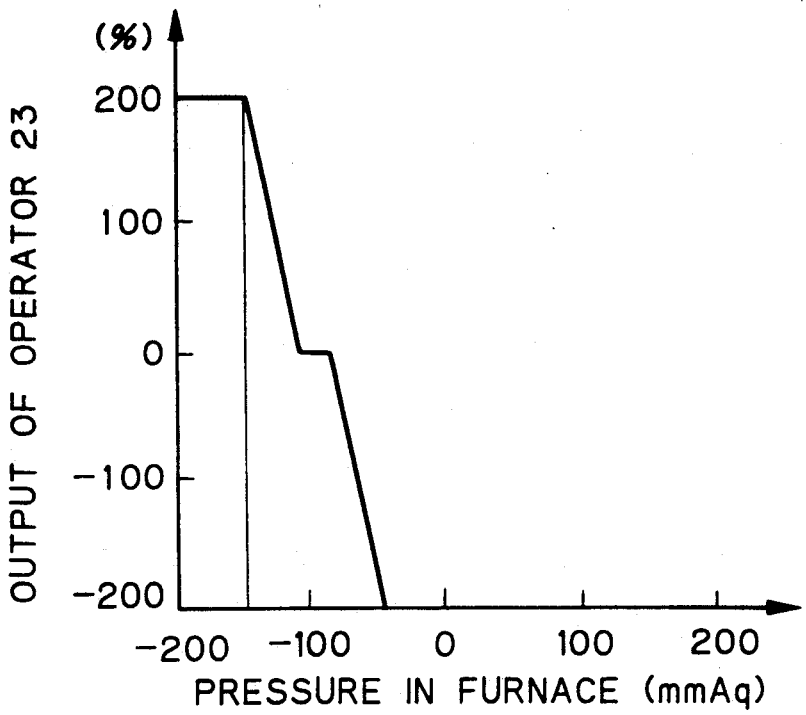

FIG. 13 shows a second type of output characteristic of the non-linear operator 23. When the furnace pressure is not lower than −50 mmAq, the second type output is also always −200% which causes the addition gas control damper 22 to be fully closed. When the furnace pressure is not higher than −150 mmAq, the output of the non-linear operator 23 is also a high constant value which causes the additional gas control damper 22 to be fully opened. In addition, the output is a constant linear value when the furnace pressure is in the vicinity of the furnace pressure set value SV of said PID controller.

This constant linear value is represented by the horizontal step shown in FIG. 13.

When the output is this constant linear value, the addition gas control damper 22 is retained in position without being moved by the controller. Thus, it becomes possible to prevent the addition gas control damper 22 from excessively responding to the furnace pressure when the furnace pressure is in the vicinity of the set value of the PID controller, and to generate the advantageous effects of preventing the furnace pressure from being fluctuated.

Figure 14:
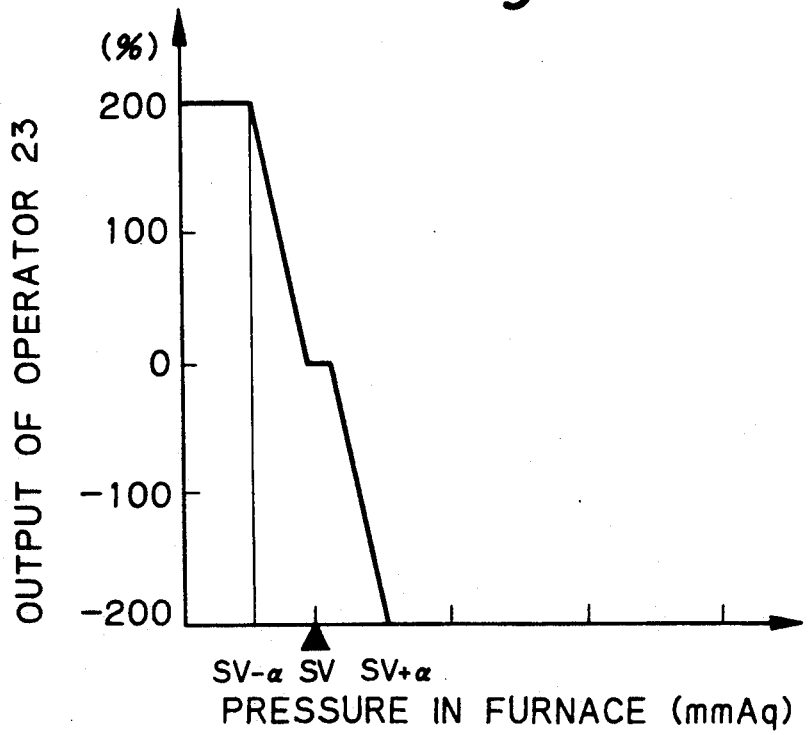

FIG. 14 shows a third type of output characteristic of the non-linear operator 23 which is similar to that shown in FIG. 13, except that the constant linear value is output based on the set value SV of the PID controller, whereby it becomes possible to change automatically the output characteristic of the non-linear operator 23 when the set value SV of the PID controller is changed, resulting in the advantageous effects of preventing the furnace pressure from being fluctuated due to a deviation of the set value SV of the PID controller from the constant linear value output characteristic of the non-linear operator 23.

Thus, according to the present invention, an addition gas control damper is installed in an addition gas line L for feeding either part of the flow of exhaust gas induced by the induced draft fan or air taken in from the atmosphere to the inlet of the remote-control exhaust gas damper or the inlet of the exhaust gas treating device or the inlet of the exhaust gas cooler or the inside of the incinerator, and the addition gas control damper is controlled on the basis of the furnace pressure controller, thereby controlling the furnace pressure. Accordingly, it is possible to operate the induced draft fan with its maximum capacity at all times and hence it is possible to stabilize the furnace pressure promptly.

Although the present invention has been described through specific terms, it should be noted here that the described embodiments are not necessarily exclusive and that various changes and modifications may be imparted thereto without departing from the scope of the invention which is limited solely by the appended claims.

What is claimed is:

1. A method of controlling the pressure in an incinerator comprising:

passing exhaust gas from said incinerator through an exhaust gas treating device and then discharging it into the atmosphere by the action of an induced draft fan;

adding gas to a gas flow path upstream of the inlet of said induced draft fan through an addition gas line provided with an addition gas control damper; and controlling said addition gas control damper on the basis of the output from a furnace pressure controller by closing the damper when the furnace pressure is relatively high to reduce the flow rate of the addition gas, and by opening the damper when the furnace pressure is relatively low to increase the flow rate of the addition gas, wherein the output of said furnace pressure controller is produced by incorporating a first gain when the furnace pressure is on the plus side of a predetermined value, and by incorporating a second gain when the furnace pressure is on the minus side of said set value, said first gain being greater than said second gain so that when the furnace pressure is on the plus side, said addition gas control damper is operated at a relatively high speed.

2. The method as claimed in claim 1, wherein the step of adding gas to the gas flow path comprises adding exhaust gas induced by said induced draft fan to the gas flow path.

3. A method of controlling the pressure in an incinerator comprising:

passing exhaust gas from said incinerator through an exhaust gas treating device and then discharging it into the atmosphere by the action of an induced draft fan;

adding gas to a gas flow path upstream of the inlet of said induced draft fan through an addition gas line provided with an addition gas control damper;

controlling said addition gas control damper on the basis of the output from a furnace pressure controller by closing the control damper when the furnace pressure is relatively high to reduce the flow rate of the addition gas, by opening the control damper when the furnace pressure is relatively low to increase the flow rate of the addition gas, and by operating said addition control damper more rapidly when a sudden change of furnace pressure toward the plus side of a predetermined value is detected.

4. A method of controlling the pressure in an incinerator comprising:

passing exhaust gas from said incinerator through an exhaust gas treating device and then discharging it into the atmosphere by the action of an induced draft fan;

adding gas to a gas flow path upstream of the inlet of said induced draft fan through an addition gas line provided with an addition gas control damper; and controlling said addition gas control damper on the basis of the output from a furnace pressure controller by closing the control damper when the furnace pressure is relatively high to reduce the flow rate of the addition gas, and by opening the control damper when the furnace pressure is relatively low to increase the flow rate of the addition gas, wherein said output of said furnace pressure controller that controls said addition gas control damper is produced by summing the output of a PID controller in the form of a fundamental manipulated variable and the output of a non-linear operator having a characteristic of generating an output which is inversely proportional to the furnace pressure over a given range.

5. The method as claimed in claim 4, wherein the step of controlling comprises fully closing the control damper when the furnace pressure is higher than a first predetermined pressure, and fully opening the control damper when the furnace pressure is lower than a second predetermined pressure.

6. The method as claimed in claim 5, wherein the non-linear operator outputs a constant value when the furnace pressure is any pressure within a range near a furnace pressure set value used in a comparison made by the PID controller.

7. The method as claimed in claim 6, wherein the center of said range corresponds to the furnace pressure set value.

8. A method of controlling the pressure in an incinerator comprising:

passing exhaust gas from said incinerator through an exhaust gas treating device and then discharging it into the atmosphere by the action of an induced draft fan;

adding gas to a gas flow path upstream of the inlet of said induced draft fan through an addition gas line provided with an addition gas control damper; and controlling said addition gas control damper on the basis of the output from a furnace pressure controller by closing the control damper when the furnace pressure is relatively high to reduce the flow rate of the addition gas, and by opening the control damper when the furnace pressure is relatively low to increase the flow rate of the addition gas, wherein a first gain is incorporated in the output of said controller when the furnace pressure is on the plus side of a predetermined value and a second gain, smaller than said first gain, is incorporated in the output of said controller when the furnace pressure is on the minus side of said predetermined value, and the sum of the output of a PID controller in the form of a fundamental manipulated variable and the output of a non-linear operator having a characteristic of generating an output which is inversely proportional to the furnace pressure is also incorporated in the output of said furnace pressure controller so that said addition control damper is operated even more rapidly when a sudden change of furnace pressure toward the plus side of said predetermined value is detected.

* * * * *